US009542836B2

(12) United States Patent
Fujita et al.

(10) Patent No.: US 9,542,836 B2
(45) Date of Patent: Jan. 10, 2017

(54) HOUSEHOLD ELECTRIC APPLIANCE, HOUSEHOLD ELECTRIC SYSTEM, AND SERVER APPARATUS

(71) Applicant: Panasonic Intellectual Property Management Co., Ltd., Osaka-shi, Osaka (JP)

(72) Inventors: Naoto Fujita, Shiga (JP); Jun Akiyama, Shiga (JP); Takehiko Nitta, Kyoto (JP); Kohei Nozaki, Osaka (JP); Hirokazu Kamoda, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 4 days.

(21) Appl. No.: 14/419,637

(22) PCT Filed: Aug. 1, 2013

(86) PCT No.: PCT/JP2013/004679

§ 371 (c)(1),
(2) Date: Feb. 4, 2015

(87) PCT Pub. No.: WO2014/024444

PCT Pub. Date: Feb. 13, 2014

(65) Prior Publication Data

US 2015/0187207 A1 Jul. 2, 2015

(30) Foreign Application Priority Data

Aug. 8, 2012 (JP) ..... 2012-176200
Aug. 8, 2012 (JP) ..... 2012-176202

(51) Int. Cl.
*G08C 19/16* (2006.01)
*G08C 17/02* (2006.01)
(Continued)

(52) U.S. Cl.
CPC ..... *G08C 17/02* (2013.01); *F24F 3/065* (2013.01); *F24F 5/0096* (2013.01); *F24F 11/006* (2013.01); *F24F 2011/0068* (2013.01)

(58) Field of Classification Search
None
See application file for complete search history.

(56) References Cited

U.S. PATENT DOCUMENTS

2004/0107717 A1* 6/2004 Yoon ..... F24F 11/006 62/230
2006/0064717 A1 3/2006 Shibata et al.
(Continued)

FOREIGN PATENT DOCUMENTS

EP 2 058 598 A2 5/2009
JP 4-137163 5/1992
(Continued)

OTHER PUBLICATIONS

Extended European Search Report issued in corresponding European Patent Application No. 13827845.2, Oct. 28, 2015 (9 pages).
(Continued)

*Primary Examiner* — Ojiako Nwugo
(74) *Attorney, Agent, or Firm* — Hamre, Schumann, Mueller & Larson, P.C.

(57) ABSTRACT

Provide are a household electric appliance, household electric system and server apparatus that perform operation start or stop at reserved set times and that are convenient with regard to reserving operation. A household electric appliance capable of a reserved operation of performing an operation start or stop at a set time comprises: a receiving unit that receives a setting signal indicative of an operation start time in the reserved operation of the household electric appliance from each of a remote controller and a mobile terminal; a storage unit that stores the setting signal; and a control unit that controls operation of the household electric appliance.
(Continued)

The control unit, in the case of overlapping of an operation time zone defined by the setting signal from the remote controller and the operation time zone defined by the setting signal from the mobile terminal, selects the earlier time and performs the operation start.

10 Claims, 14 Drawing Sheets

(51) Int. Cl.

| | |
|---|---|
| ***F24F 3/06*** | (2006.01) |
| ***F24F 5/00*** | (2006.01) |
| ***F24F 11/00*** | (2006.01) |

(56) References Cited

U.S. PATENT DOCUMENTS

| | | | | |
|---|---|---|---|---|
| 2009/0133048 | A1* | 5/2009 | Gibbs | G06F 17/30038 725/14 |
| 2010/0158476 | A1* | 6/2010 | Hao | H04N 5/782 386/291 |
| 2010/0231432 | A1* | 9/2010 | Shigei | G08C 17/02 341/176 |
| 2011/0013878 | A1 | 1/2011 | Fukushima | |
| 2012/0101652 | A1* | 4/2012 | Shin | H02J 3/14 700/296 |

FOREIGN PATENT DOCUMENTS

| | | | |
|---|---|---|---|
| JP | 2004-221787 | | 8/2004 |
| JP | 2005-337614 | A | 12/2005 |
| JP | 2006-020248 | | 1/2006 |
| JP | 2006-86637 | | 3/2006 |
| JP | 2006-211085 | | 8/2006 |
| JP | 2009-278193 | | 11/2009 |
| JP | 4465924 | B | 5/2010 |
| JP | 2011-23977 | | 2/2011 |
| JP | 2011-71879 | | 4/2011 |
| KR | 2008-0057994 | A | 6/2008 |
| KR | 2009-0052744 | A | 5/2009 |
| KR | 2011-0020554 | A | 3/2011 |

OTHER PUBLICATIONS

International Preliminary Report on Patentability and Written Opinion, Jan. 2015; PCT/JP2013/004679 (7 pages).

* cited by examiner

SECOND EMBODIMENT

THIRD EMBODIMENT

HOUSEHOLD ELECTRIC APPLIANCE, HOUSEHOLD ELECTRIC SYSTEM, AND SERVER APPARATUS

TECHNICAL FIELD

This disclosure relates to a household electric appliance, a household electric system, and a server apparatus.

BACKGROUND ART

Conventionally, various remote control systems have been developed for household electric appliances. The remote control system described in Patent Document 1 transmits an operation start or stop signal to an appliance input in a menu screen at the time input in the menu screen. Further, the remote control system of Patent Document 1 transmits a signal to notify Internet-connectable terminals that the appliance is in operation.

PRIOR ART DOCUMENT

Patent Document

Patent Document 1: JP4465924B

SUMMARY OF THE INVENTION

Problem to be Solved by the Invention

One non-limiting and exemplary embodiment provides a household electric appliance, a household electric system, and a server apparatus that have enhanced convenience in an operation reservation and are capable of starting or stopping the operation on time at a reserved setting time.

Means to Solve the Problem

In one embodiment, a household electric appliance capable of a reserved operation of performing an operation start or stop at a set time comprises: a receiving unit that receives a setting signal indicative of an operation start time in the reserved operation of the household electric appliance from each of a remote controller and a mobile terminal; a storage unit that stores contents of the setting signal; and a control unit that controls the operation of the household electric appliance. The control unit, in the case of at least partially overlapping of an operation time zone defined by the setting signal from the remote controller and the operation time zone defined by the setting signal from the mobile terminal, selects the earlier time out of the operation start times set by the remote controller and the mobile terminal and performs the operation start at the selected time.

Additionally, in other embodiment, a server apparatus that enables a reserved operation of a household electric appliance from a mobile terminal by way of a network comprises: a communicating unit that performs a communication with the mobile terminal and the household electric appliance by way of the network; and a control unit that receives information indicative of an operation start time or an operation stop time in the reserved operation of the household electric appliance from the mobile terminal by way of the communicating unit and transmits a setting signal indicative of the operation start time or the operation stop time to the household electric appliance. The control unit, after a first transmission of the setting signal, a predetermined time before the operation start time or the operation stop time indicated by the setting signal, transmits a signal to instruct starting or stopping of the operation the predetermined time later to the household electric appliance.

Additionally, in other embodiment, a household electric appliance capable of a reserved operation of performing an operation start or stop at a set time comprises: a receiving unit that receives a setting signal indicative of an operation start time or an operation stop time in the reserved operation of the household electric appliance from a predetermined server apparatus connected by way of a network; a control unit that controls the operation of the household electric appliance; and a storage unit that stores data. The control unit, after a first reception of the setting signal, a predetermined time before the operation start time or the operation stop time indicated by the setting signal, receives a setting signal instructing starting or stopping of the operation the predetermined time later, stores contents of the setting signal in the storage unit, and executes the reserved operation in accordance with the contents of the setting signal stored in the storage unit.

Effect of the Invention

The above embodiments can provide the household electric appliance, the household electric system, and the server apparatus that perform an operation start or an operation stop on time at the reserved setting time and further have enhanced convenience in the operation reservation.

MODE FOR CARRYING OUT THE INVENTION

Preferred embodiments according to the present invention will now be described with reference to the drawings.

First Embodiment

A remote control system for household electric appliances according to conventional technologies does not provide a solution to how to process overlapped reservations. For example, as to the remote control system according to Patent Document 1, there is no description of the case of the overlapped reservations made from a remote controller attached to the household electric appliance and from a mobile terminal connectable to the Internet.

The household electric appliance and the household electric system according to a first embodiment operate properly when overlapped reservation data are input from the remote controller attached to the household electric appliance and from the mobile terminal connectable to the Internet. Namely, the first embodiment provides the household electric appliance and the household electric system that give priority to convenience from user's viewpoint in such a case.

The household electric appliance and the household electric system according to the first embodiment will now be described with reference to FIGS. 1 to 17. In the following, description will be made citing the household electric system having an air-conditioner as the household electric appliance. The household electric appliance of the present disclosure is not limited to the air-conditioner but this embodiment is applicable to other household electric appliances, such as, for example, a refrigerator, a rice cooker, a washing machine, etc.

<1-1 Configuration>

1-1-1 Overall Configuration of Household Electric System

Figure 1:
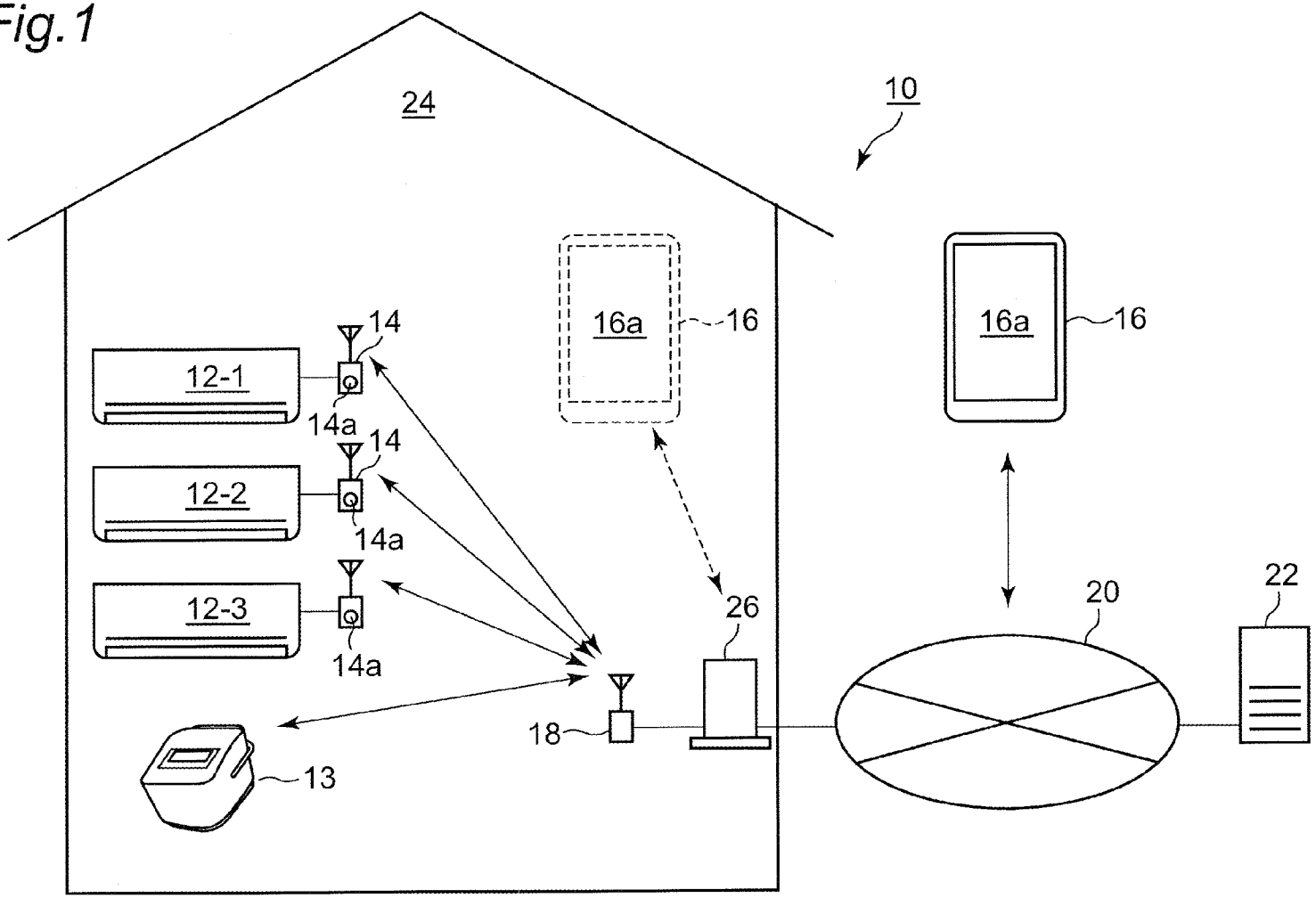
FIG. 1 is a diagram of a household electric system according to a first embodiment.

A configuration will now be described of the household electric system according to the first embodiment with reference to FIG. 1. As shown in FIG. 1, a household electric system 10 is a system to control a plurality of household electric appliances by a mobile terminal 16, etc. This embodiment includes three air-conditioners 12-1 to 12-3 and a rice cooker 13 as the plurality of household electric appliances.

The household electric system 10 according to the first embodiment has the air-conditioners 12-1 to 12-3, the rice cooker 13, a radio adaptor (communication device) 14, a mobile terminal 16, a gateway device (relay device) 18, a router device 26, the Internet 20, and a server apparatus 22.

In the first embodiment shown in FIG. 1, three units of the air-conditioners 12-1 to 12-3 are arranged inside a user's house 24. Three units of the air-conditioners 12-1 to 12-3 are arranged, for example, in different rooms inside the house 24. Likewise, the rice cooker 13 is arranged inside the house 24.

The radio adaptor (communication device) 14, arranged to be electrically connected to a control unit of each of the air-conditioners 12-1 to 12-3, communicates with the gateway device 18. The radio adaptor 14 receives an operation signal to operate the air-conditioners 12-1 to 12-3 transmitted from the gateway device 18 and outputs the received operation signal to the control unit of the air-conditioner 12. Based on this operation signal, the air-conditioners 12-1 to 12-3 perform a corresponding operation.

The radio adaptor 14 acquires identification information (e.g., manufacturing serial number, model number, etc.) of the air-conditioners 12-1 to 12-3 from the control unit of the air-conditioners 12-1 to 12-3 and transmits the information to the gateway device 18. The radio adaptor 14 may be disposed integrally with the air-conditioners 12-1 to 12-3. The radio adaptor 14 may be disposed to be attachable and detachable to and from the air-conditioners 12-1 to 12-3 so that the radio adaptor 14 can be connected to any of a plurality of air-conditioners 12-1 to 12-3. The rice cooker 13 according to the first embodiment communicates with the gateway device 18 by, for example, an integrated radio adaptor (not shown) incorporated in the main body of the rice cooker 13. The control unit will be described later of each of the air-conditioners 12-1 to 12-3.

Each radio adaptor 14 has a "connection" button **14*a*. The "connection" button 14*a* is a button for newly connecting individual radio adaptor 14 to the gateway device 18. When the "connection" button 14*a* is operated by the user, the radio adaptor 14 equipped with the "connection" button 14*a* acquires the identification information of the air-conditioners 12-1 to 12-3 from the control unit of the air-conditioners 12-1 to 12-3. The identification information is, for example, the manufacturing serial number or the model number. The radio adaptor 14 transmits the acquired identification information to the gateway device 18**.

The mobile terminal 16 is a general-purpose portable terminal such as a smartphone and a tablet PC (personal computer). The mobile terminal 16 has a connection means of connecting with the Internet 20 and a communication means of communicating with the router device 26. The mobile terminal 16 (e.g., smartphone) can connect with the Internet 20 by way of a telephone network (e.g., 3G network).

The mobile terminal 16 can connect with the router device 26 and the household electric appliances by, for example, a Wi-Fi communication, a Bluetooth (registered trademark) communication, or an infrared communication, etc. In this case, a device for such a purpose (e.g., Wi-Fi antenna, etc.) is incorporated in the mobile terminal 16.

The router device 26 can communicate with the mobile terminal 16 by, for example, the Wi-Fi communication, etc. The router device 26 can communicate with the air-conditioners 12-1 to 12-3 and the rice cooker 13 by the router device 26 sending, by way of the gateway device (relay device) 18, a radio signal of a command, etc., received from the mobile terminal 16 and the radio adaptor 14 receiving the signal. In the example shown in FIG. 1, the radio adaptor is built in the rice cooker 13. Thus, the mobile terminal 16 can directly communicate with the household electric appliances of the air-conditioners 12-1 to 12-3, etc., inside the house 24.

As described above, the gateway device (relay device) 18 relays the communication between the radio adaptor 14 and the router device 26. The gateway device 18 is installed inside the user's house 24. The gateway device 18 communicates with the radio adaptor 14, using, for example, a signal of a special small-scale frequency band (924.0 to 928.0 MHz) of the specified low power radio. The frequency band of the communication between the gateway device 18 and the radio adaptor 14 is preferably a low frequency band that reaches up to a long distance.

The mobile terminal 16 and the server apparatus 22 can connect with the Internet 20. Connected with the Internet 20, the mobile terminal 16 can acquire, for example, an application program to operate the air-conditioners 12-1 to 12-3 from the server apparatus 22 by way of the Internet 20. This server apparatus 22 is set up by a manufacturer of the air-conditioners 12-1 to 12-3 and, for example, builds a homepage of the manufacturer. Accordingly, an operator of the mobile terminal 16 operates the manufacturer's homepage to take the application program into the mobile terminal 16.

Installing of the above-described acquired application program in the mobile terminal 16 and starting of the installed program make it possible for the mobile terminal 16 to operate the air-conditioners 12-1 to 12-3. Namely, the operation of an operation screen of a touch panel 16*a* of the mobile terminal 16 makes it possible to generate and transmit the operation signal to operate the air-conditioners 12-1 to 12-3. The operation of the touch panel 16*a* of the mobile terminal 16, the generation of the operation signal, and the transmission of the operation signal will be described later.

The server apparatus 22 controls information, etc., necessary for an access and a verification with respect to the mobile terminal 16, the air-conditioners 12-1 to 12-3, the radio adaptor 14, and the gateway device 18. For example, the server apparatus 22 verifies (judges) whether the identification information of the mobile terminal 16 contained in a communication request signal from the mobile terminal 16 and the identification information of the mobile terminal stored (registered) in the gateway device 18 match. If these match, then the server apparatus 22 verifies the mobile terminal 16 making the communication request (trying to access) as a legitimate mobile terminal, permitting its communication with the household electric appliance inside the house 24.

Thus, the mobile terminal 16 accesses the server apparatus 22 by way of the Internet 20, outside the house 24. With the verification by the server apparatus 22, the mobile terminal 16 can indirectly communicate with the household electric appliances of the air-conditioners 12-1 to 12-3, etc., by way of the router device 26 and the gateway device 18. The mobile terminal 16 can also communicate directly with the household electric appliances of the air-conditioners 12-1 to 12-3, etc., by way of the router device 26 and the gateway device 18, inside the house 24. In this case, the mobile terminal 16 does not access the server apparatus 22 from the Internet 20.

1-1-2 Configuration of Air-Conditioner

Figure 2:
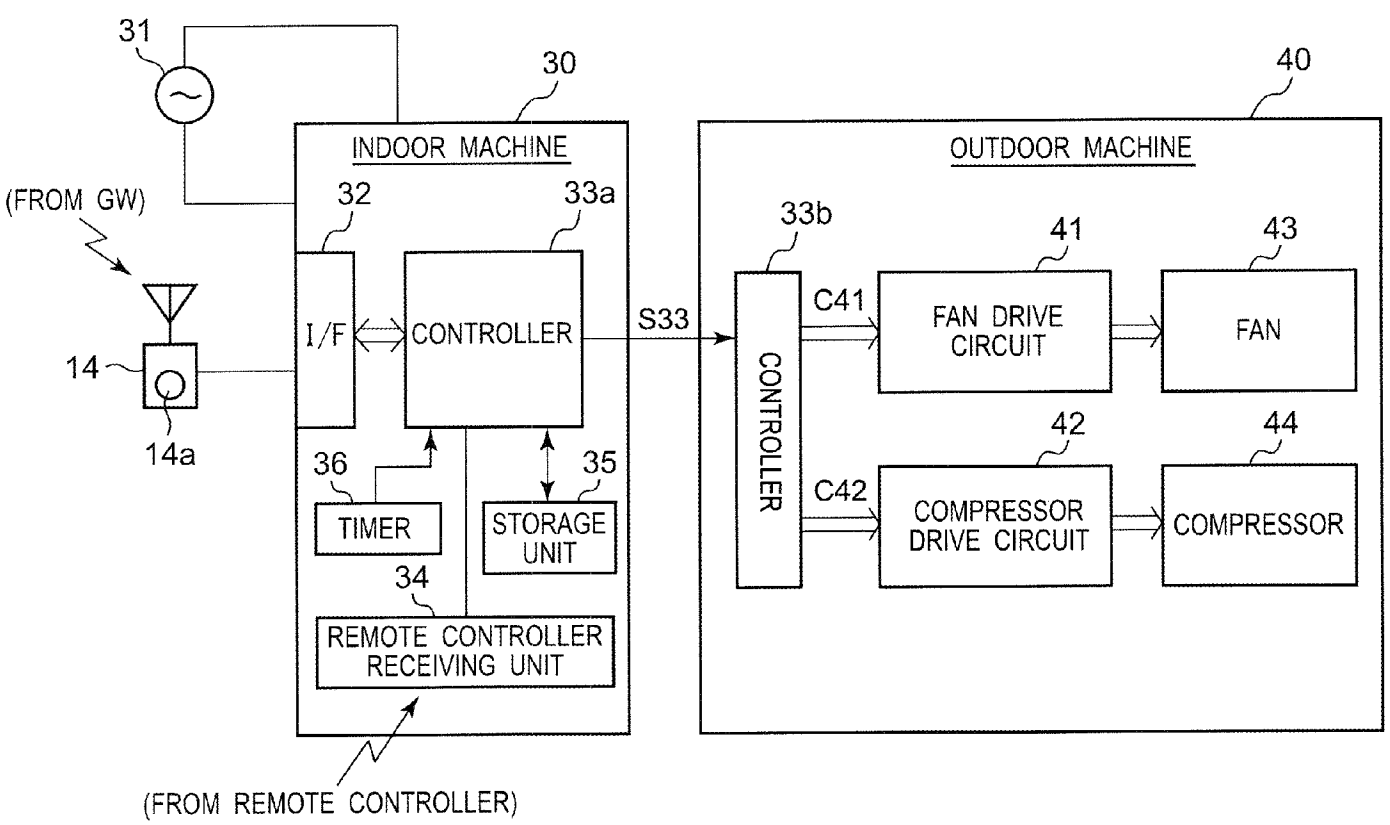
FIG. 2 is a diagram of a configuration of an air-conditioner according to the first embodiment.

The configuration will then be described of the air-conditioner according to the first embodiment with reference to FIG. 2. The air-conditioner 12-1 in FIG. 1 is cited as an example. The configuration related with the refrigerating cycle is omitted in FIG. 2.

As shown in FIG. 2, the air-conditioner 12-1 according to the first embodiment is composed of an indoor machine 30 and an outdoor machine 40. For example, the indoor machine 30 is disposed inside the house 24 and the outdoor machine 40 is disposed outside the house 24.

The indoor machine 30 has an interface 32, a controller 33*a*, a remote controller receiving unit 34, a storage unit 35, and a timer 36. The indoor machine 30 is supplied with power from, for example, an AC source 31 as a commercial power source inside the house 24.

The interface (I/F) 32 performs exchange of data, etc., between the radio adaptor 14 and the air-conditioner 12-1 (controller 33*a*).

The controller (control unit) 33*a* controls an overall operation of the indoor machine 30. The controller 33*a* receives an instruction of a predetermined operation reservation action from the interface 32 and the remote controller receiving unit 34 as a receiving unit. Upon reception of the instruction of the predetermined operation reservation action, the controller 33*a* controls the indoor machine 30 to execute the operation reservation action and further transmits an instruction signal S33 to a controller 33*b* of the outdoor machine 40. Details of the operation reservation action will be described later.

The remote controller receiving unit 34 receives a remote controller operation signal from a main body remote controller of this air-conditioner 12-1 and transmits the signal to the controller 33*a*. The controller 33*a* in reception of the remote controller operation signal from the main body remote controller controls the operation of the air-conditioner 12-1 depending on the operation signal, in the same manner as in the case of the instruction from the mobile terminal 16.

The storage unit 35 stores fixed contents (operation start time, operation stop time, etc.) of a reserved operation. The data, etc., stored in the storage unit 35 will be described later.

The timer 36 notifies the controller 33*a* of the current time. The timer 36 notifies the controller 33*a* of the time that is set at zero when the operation reservation is set and that is counted down or counted up as the time elapses.

The outdoor machine 40 has the controller 33*b*, a fan drive circuit 41, a compressor drive circuit 42, a fan 43, and a compressor 44. The outdoor machine 40 is supplied with power from the indoor machine 30.

The fan drive circuit 41 receives a control signal C41 from the controller 33*b* to control the drive of the fan 43 in respect of the number of rotations, etc.

The compressor (compressing machine) drive circuit 42 receives a control signal C42 from the controller 33*b* to control the drive of the compressor (compressing machine) 44.

The fan 43 operates under control of the fan drive circuit 41 and generates an airflow to radiate or absorb heat of refrigerant in an outdoor heat exchanger (not shown).

The compressor (compressing machine) 44, under control of the compressor drive circuit 42, compresses the refrigerant (not shown) circulating inside the air-conditioner 12-1.

<1-2 Control Setting by Mobile Terminal>

A control setting by the mobile terminal to the air-conditioner according to the first embodiment will then be described. In the following, with respect to a temperature setting, etc., of the air-conditioners 12-1 to 12-3, the setting (remote control mode) will be described in the case of performing the same control as done by the attached remote controller, using the touch panel 16*a* of the mobile terminal 16. It is assumed that the mobile terminal 16 is the smartphone, etc., having the touch panel 16*a* and that an operation program for the air-conditioners 12-1 to 12-3 is already installed in the mobile terminal 16 from the server apparatus 22 and is already started.

Figure 3:
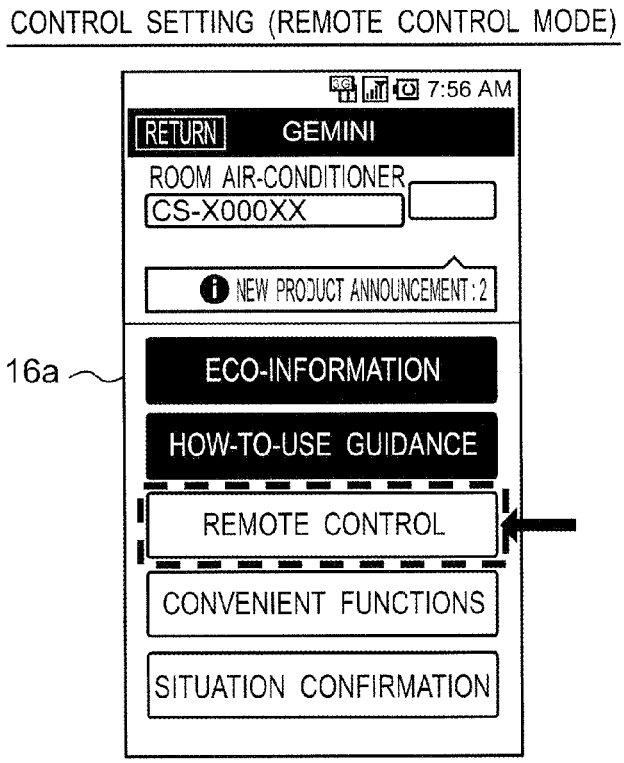
FIG. 3 is a diagram of a control setting in a mobile terminal in the household electric system according to the first embodiment.

In the mobile terminal 16, upon start of the operation program of the air-conditioner 12-1 (model number: CS-X00XX), a screen including various selection items is displayed on a display panel 16*a* of the mobile terminal 16, as shown in FIG. 3.

Figure 4:
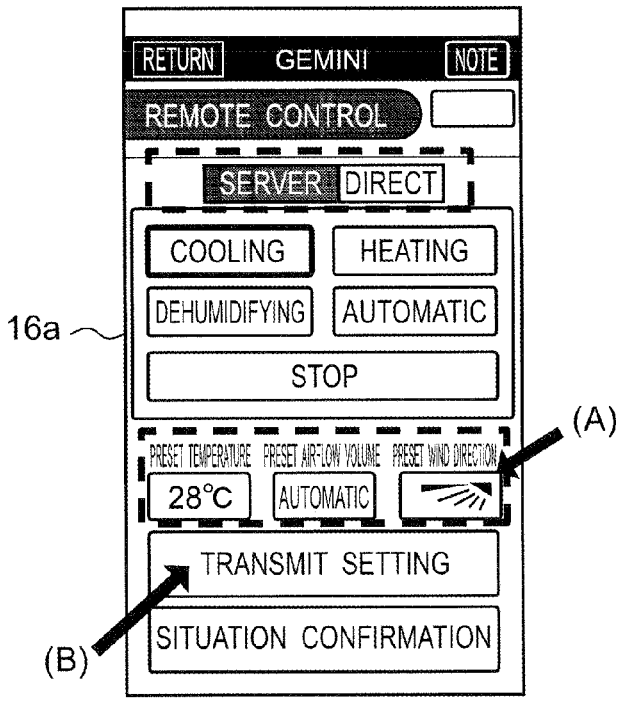
FIG. 4 is a diagram of the control setting in the mobile terminal in the household electric system according to the first embodiment.

If the item of "remote control" is selected by the user, selection buttons related with "remote control" are displayed on the display panel 16*a*, as shown in FIG. 4. Specifically, the selection buttons are displayed of "server", "direct", "cooling", "heating", "dehumidifying", "automatic", "stop", etc. If the "server" is selected, the mobile terminal 16 can communicate with the air-conditioners 12-1 to 12-3 in a communication channel by way of the server apparatus 22. If the "direct" is selected, the mobile terminal 16 can communicate with the air-conditioners 12-1 to 12-3 in the communication channel by way of the router device 26, not by way of the server apparatus 22. If the "cooling", "heating", "dehumidifying", or "automatic" is selected, the air-conditioners 12-1 to 12-3 are operated in the selected operation mode. If the "stop" is selected, the motion of the air-conditioners 12-1 to 12-3 in operation is stopped.

Figure 5:
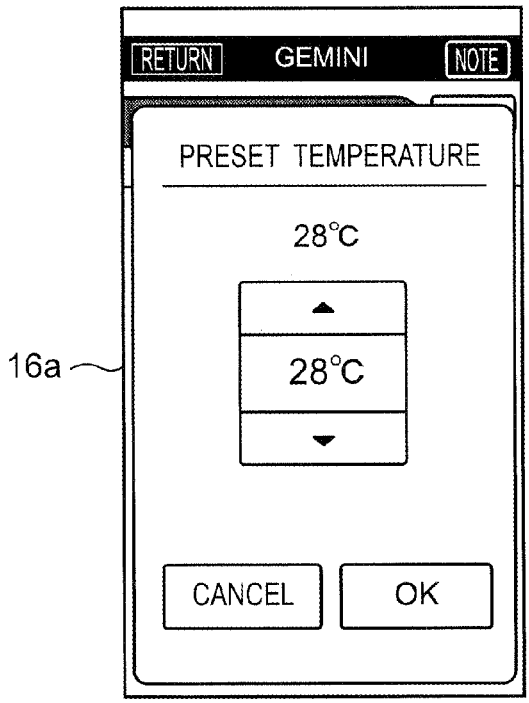
FIG. 5 is a diagram of the control setting in the mobile terminal in the household electric system according to the first embodiment.

(A-1) If the item of "preset temperature" inside a broken line in FIG. 4 is selected by the user, the selection buttons related with the "preset temperature" is displayed on the display panel (touch panel) 16*a*, as shown in FIG. 5. In FIG. 5, the "preset temperature (28° C. in this example)" is displayed. By selection of "OK", the selected preset temperature is fixed and by selection of "cancel", the selected preset temperature is cancelled.

Figure 6:
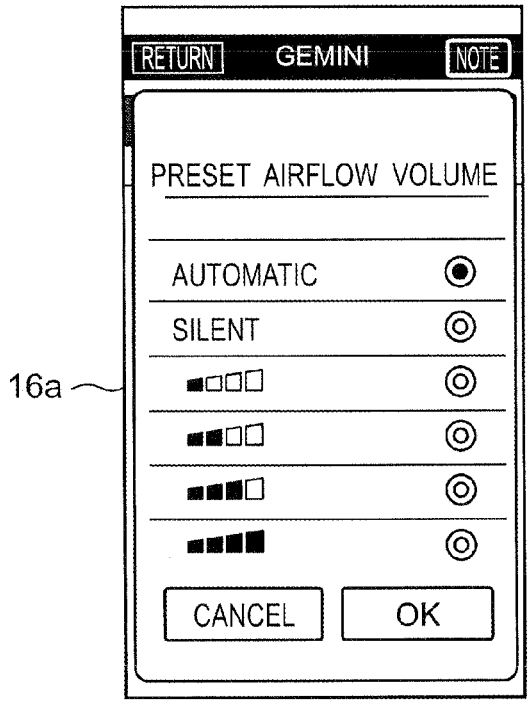
FIG. 6 is a diagram of the control setting in the mobile terminal in the household electric system according to the first embodiment.

(A-2) Likewise, if the item of "preset airflow volume" inside the broken line in FIG. 4 is selected by the user, the selection buttons related with the "preset airflow volume" are displayed on the display panel (touch panel) 16*a*, as shown in FIG. 6. Specifically, "automatic", "silent", and "airflow volume" are displayed and by selection of "OK", the selected preset airflow volume is fixed and by selection of "cancel", the selected preset airflow volume is cancelled.

Figure 7:
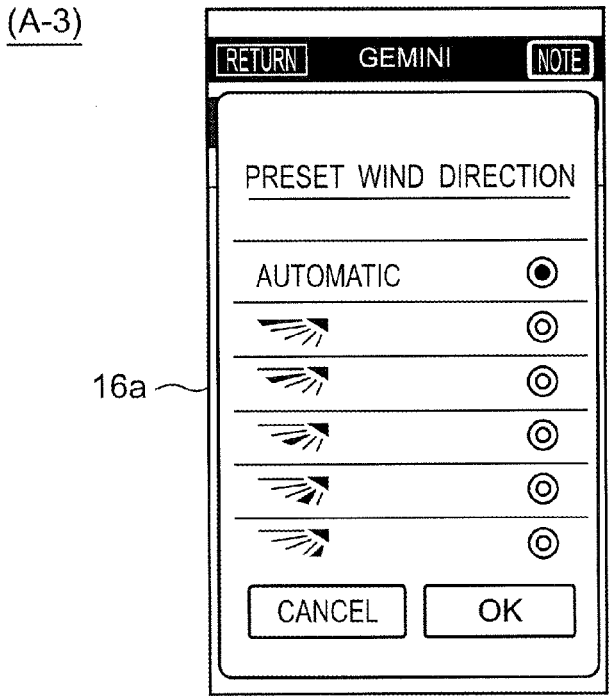
FIG. 7 is a diagram of the control setting in the mobile terminal in the household electric system according to the first embodiment.

(A-3) Likewise, if the item of "preset wind direction" inside the broken line in FIG. 4 is selected by the user, the selection buttons related with the "preset wind direction" are displayed on the display panel (touch panel) 16*a*, as shown in FIG. 7. Specifically, "automatic" and various "wind directions" are displayed and by selection of "OK", the selected preset wind direction is fixed and by selection of "cancel", the selected preset wind direction is cancelled.

Figure 8:
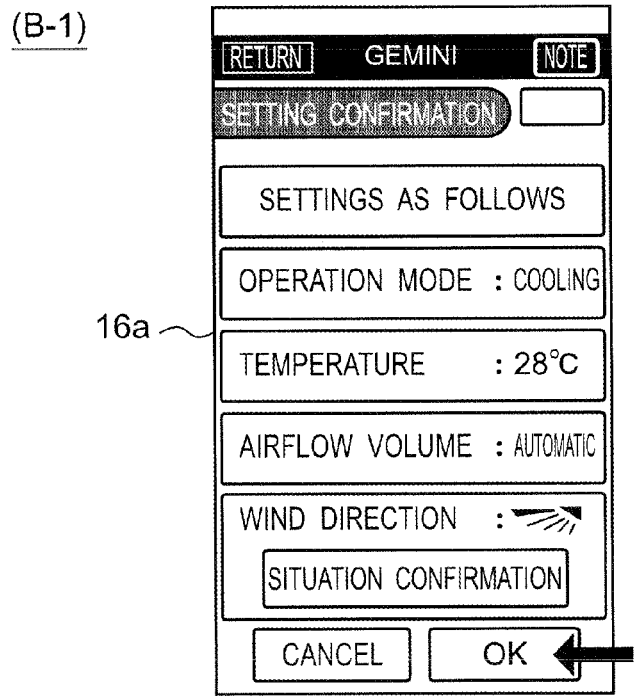
FIG. 8 is a diagram of the control setting in the mobile terminal in the household electric system according to the first embodiment.

(B-1) If the item of "transmit setting" in FIG. 4 is selected by the user, contents related with "setting confirmation" are displayed on the display panel 16*a*, with respect to contents of the setting described by FIGS. 5 to 7, as shown in FIG. 8. Specifically, the "operation mode (cooling in this example)", the "temperature (28° C. in this example)", the "airflow volume (automatic in this example)", and the "wind direction (upward in this example)" are displayed.

Figure 9:
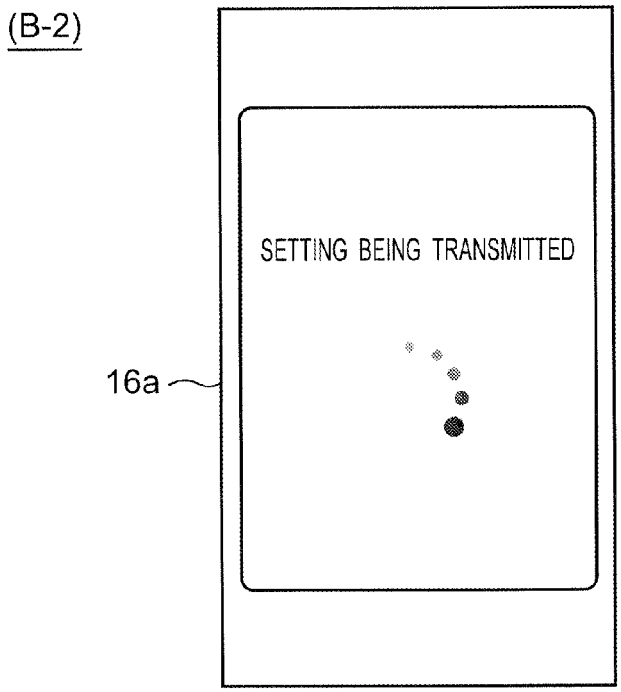
FIG. 9 is a diagram of the control setting in the mobile terminal in the household electric system according to the first embodiment.

(B-2) If "OK" in FIG. 8 is selected, the setting contents shown in FIG. 8 are transmitted to the air-conditioner 12-1. At this moment, to indicate that the setting contents shown in FIG. 8 are being transmitted to the air-conditioner 12-1, a "setting being transmitted" message is displayed on the display panel (touch panel) 16*a*, as shown in FIG. 9.

Figure 10:
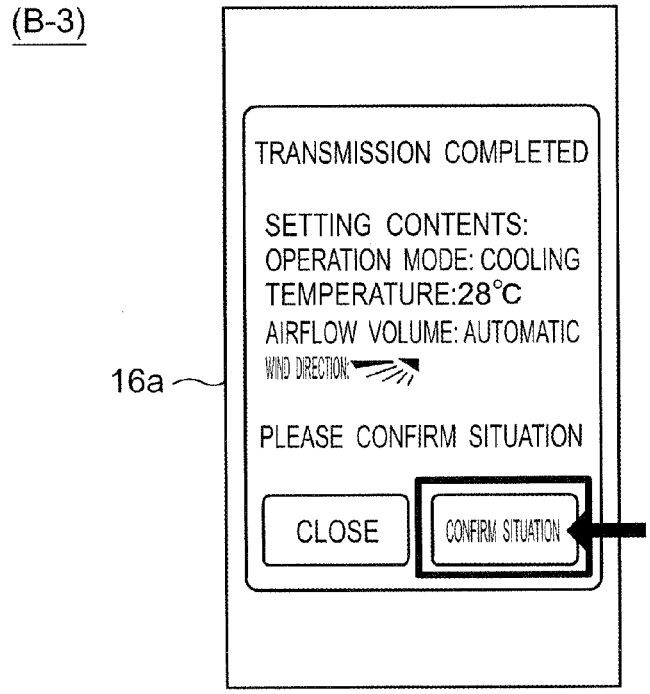
FIG. 10 is a diagram of the control setting in the mobile terminal in the household electric system according to the first embodiment.

(B-3) Thereafter, when the transmission is completed, the screen shown in FIG. 10 is displayed. If "confirm situation" is selected on this screen, the setting contents transmitted are displayed on the display panel (touch panel) 16*a*. If "close" is selected, the display of the display panel (touch panel) 16*a* is closed and the display panel (touch panel) 16*a* of the mobile terminal 16 returns to its initial state.

<1-3 Calendar Reservation Action>

A calendar reservation action in the air-conditioner 12-1 according to the first embodiment will then be described.

1-3-1 Setting of Calendar Reservation Action

Setting will be described of the calendar reservation action in the air-conditioner according to the first embodiment with reference to FIGS. 11 to 15. In the following, the setting by way of the touch panel 16*a* of the mobile terminal 16 will be cited as an example. It is assumed that the mobile terminal 16 is the smartphone, etc., having the touch panel 16*a* and that the operation program for the air-conditioner 12-1 is already installed in the mobile terminal 16 from the server apparatus 22 and is already started.

Figure 11:
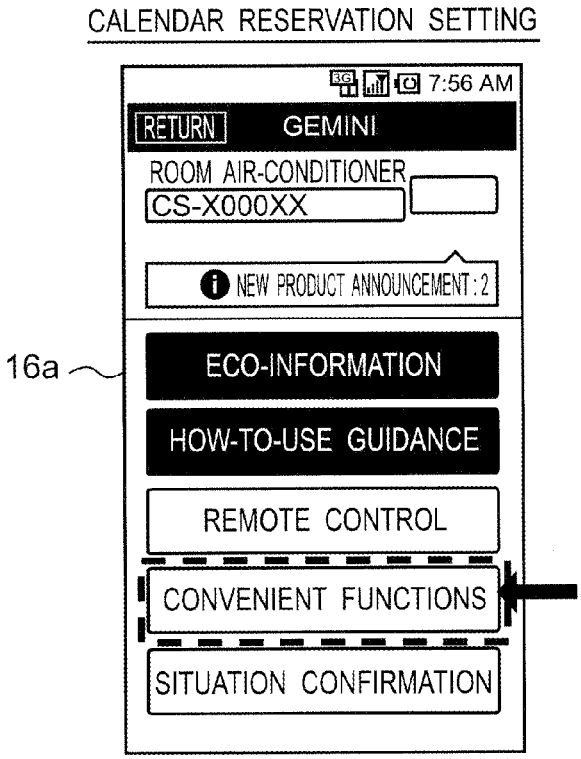
FIG. 11 is a diagram of a calendar reservation setting in the mobile terminal in the household electric system according to the first embodiment.

In the mobile terminal 16, upon start of the operation program of the air-conditioner 12-1 (model number: CS-X00XX), the screen including various selection items is displayed on the display panel (touch panel) 16*a* of the mobile terminal 16, as shown in FIG. 11.

Figure 12:
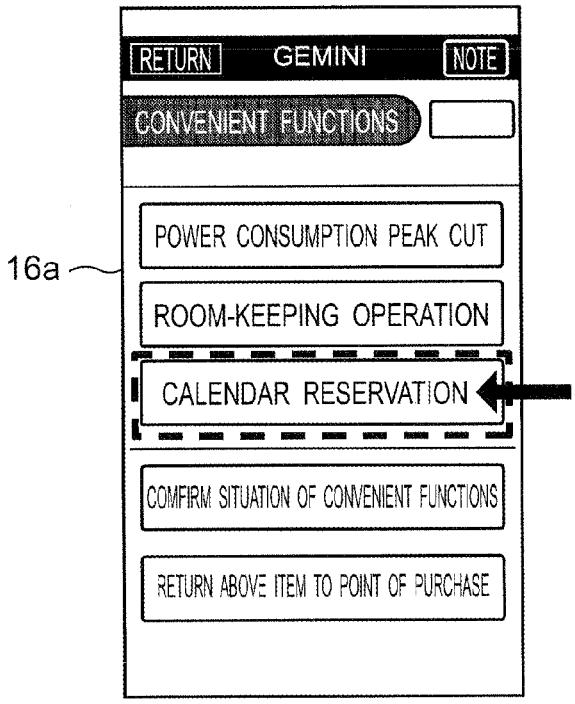
FIG. 12 is a diagram of the calendar reservation setting in the mobile terminal in the household electric system according to the first embodiment.

If the item of "convenient functions" is selected by the user, the selection buttons related with the "convenient functions" are displayed on the display panel (touch panel) 16*a*, as shown in FIG. 12. Specifically, the selection buttons of "power consumption peak cut", "room-keeping operation", "calendar reservation", etc., are displayed.

Figure 13:
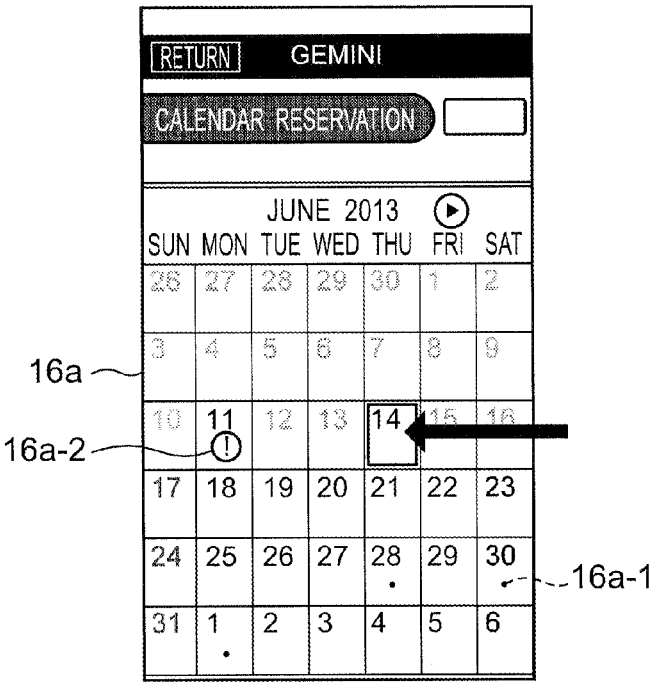
FIG. 13 is a diagram of the calendar reservation setting in the mobile terminal in the household electric system according to the first embodiment.

If the selection button of the "calendar reservation" is selected by the user, the calendar of current year/month (June, 2013 in this example) is displayed, on the display panel (touch panel) 16*a*, as the setting item related with the "calendar reservation", as shown in FIG. 13. Marking 16*a*-1 indicated by "•" in the drawing (indicated at June 28, June 30, and July 1 in this example) indicates that the operation reservation is already set. Marking 16*a*-2 indicated by "!" in the drawing (indicated at June 11 in this example) indicates that the operation reservation by the timer is not set normally. These markings 16*a*-1 and 16*a*-2 on the calendar of the display panel (touch panel) 16*a* make it possible for the user to immediately understand whether the operation reservation is normally completed. Whether to indicate such markings 16*a*-1 and 16*a*-2 as in this example may be judged by the controller 33*a* or may be judged by the server apparatus 22 to be connected by way of the Internet 20.

Figure 14:
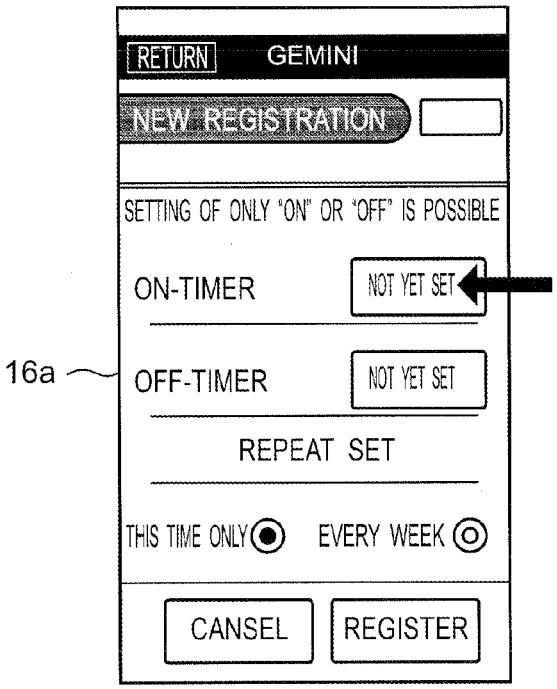
FIG. 14 is a diagram of the calendar reservation setting in the mobile terminal in the household electric system according to the first embodiment.

If a date (June 14 in this example) on the displayed calendar is selected, the screen shown in FIG. 14 is displayed and on this screen the user can select "on-timer" or "off-timer" as the setting item for a new registration of the reservation. In the displayed setting items, the user can also select "on" or "off" only. With respect to the selected timer setting, the user can further select either making the setting effective for "this time only" or making the setting effective for "every week".

Figure 15:
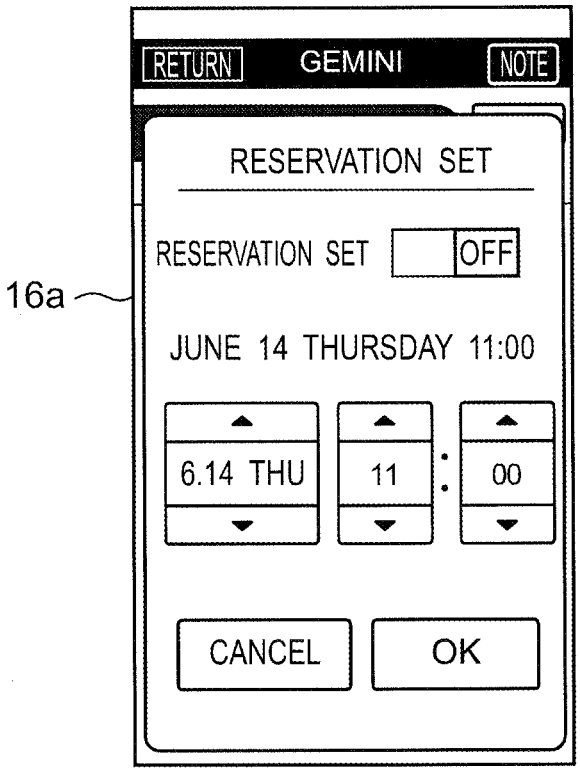
FIG. 15 is a diagram of the calendar reservation setting in the mobile terminal in the household electric system according to the first embodiment.

If "not yet set" of the "on-timer" or the "off-timer" is selected, the screen is displayed for selection (setting) of detailed time with respect to a reservation setting of the "on-timer" or the "off-timer", as shown in FIG. 15. For example, as to the "off-timer", by selecting (setting) the date, the hour, and the minute from a displayed menu, the user can reserve stopping of the operation of the air-conditioner 12-1 at "11:00 June 14 (Tues)". Then, by the selection of the "OK" button, the setting is completed of the "on-timer" or "off-timer" of the air-conditioner 12-1 with the reserved contents. On the other hand, by the selection of the "cancel" button, the reserved contents can be cancelled.

1-3-2 Calendar Reservation Determination Flow

Figure 16:
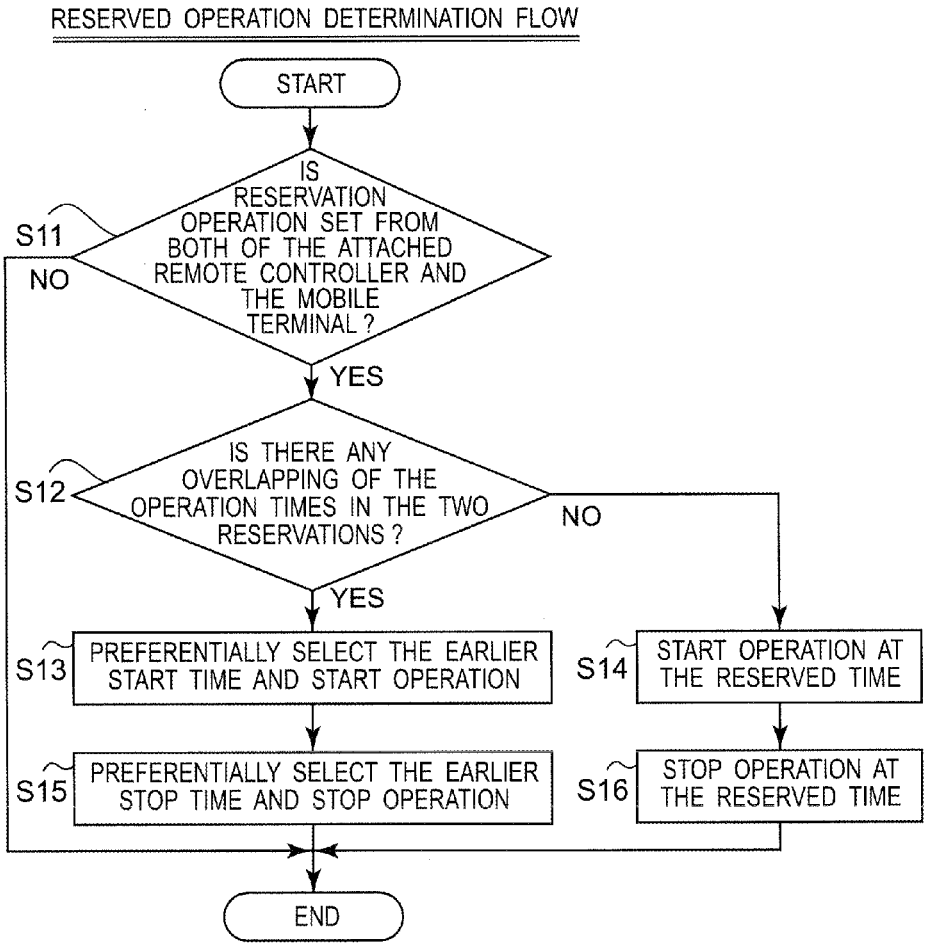
FIG. 16 is a diagram of a determination flow of the calendar reservation setting in the household electric system according to the first embodiment.

A determination flow will then be described of the calendar-reserved operation in the household electric appliance according to the first embodiment with reference to FIG. 16. In this embodiment, the reservation action described in "1-3-1" can be set, either from the attached remote controller or from the mobile terminal 16, to the air-conditioner 12-1.

The controller 33*a* determines if the calendar reservation action described in "1-3-1" is set from both of the attached remote controller and the mobile terminal 16 (step S11). Specifically, the controller 33*a*, by reading out the data of the reservation contents stored in the storage unit 35, determines if the reservation action (operation) is set from both of the attached remote controller and the mobile terminal 16. If the reservation operation is not set from both of the attached remote controller and the mobile terminal 16 (No at step S11), then this determination flow is finished.

If the reservation action (operation) is set from both of the attached remote controller and the mobile terminal 16 (Yes at step S11), then the controller 33*a* determines if there is any overlapping of the operation times in the two reservations (step S12). Specifically, the controller 33*a* refers to the contents of the two reservations stored in the storage unit 35 to determine if there are overlapped operation times.

If there are overlapped operation times (Yes at step S12), then the controllers 33*a* and 33*b* preferentially select the earlier start time out of the two overlapped operation reservations and control so that the air-conditioner 12-1 will start its operation at that start time (step S13). Specifically, the controller 33*a*, referring to the time data of the two overlapped operation reservations stored in the storage unit 35, preferentially select the earlier start time and transmits the instruction signal S33 to the controller 33*b* so that the operation start will be performed at that start time. The controller 33*b* in reception of the instruction controls the start of the operation of the outdoor machine 40 so that the operation start will be performed at the earlier start time.

On the other hand, if there are no overlapped operation times (No at step S12), then the controllers 33*a* and 33*b* control so that the operation start will be performed at the reserved time (step S14).

After step S13, the controllers 33*a* and 33*b* preferentially select the earlier stop time out of the two stop times of the overlapped reservations and control so that the operation stop of the air-conditioner 12-1 will be performed at that stop time (step S15). Specifically, the controller 33*a*, referring to the time data of the two overlapped operation reservations stored in the storage unit 35, preferentially select the earlier stop time and transmits the instruction signal S33 so that the operation stop will be performed at that stop time. The controller 33*b* in reception of the instruction controls the stop of the operation of the outdoor machine 40 so that the operation stop will be performed at the earlier stop time.

On the other hand, after step S14, the controllers 33*a* and 33*b* control so that the operation stop will be performed at the reserved time (step S16). The above completes the determination flow.

<1-4 Effect>

The household electric appliance and the household electric system according to the first embodiment can have the following effect (1).

(1) A space of more comfortable temperature can be provided and the convenience can be enhanced.

As described above, in the household electric appliance and the household electric system according to the first embodiment, when the reservation operation is set from both of the remote controller attached to the air-conditioner and the mobile terminal 16 and when there are overlapped operation times, the controllers 33*a* and 33*b* preferentially select the earlier start time in the two reservations and perform the operation start at that start time (step S13). This is based on the view that when there is the overlapping of the operation time zones of the air-conditioner, the earlier start time best reflects the user's intention, with respect to the operation start.

Figure 17:
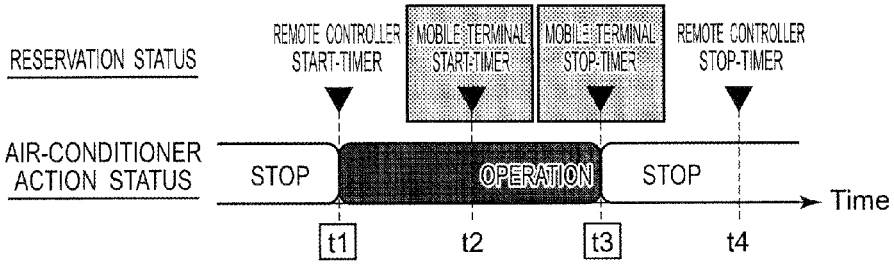
FIG. 17 is a timing chart when the calendar reservation setting is made in the household electric system according to the first embodiment.

As shown in FIG. 17 (remote controller: start t1, stop t4, mobile terminal: start t2, stop t3), it is assumed that the operation reservation is set from both of the attached remote controller and the mobile terminal 16 and that there is a partial overlapping of the operation times in the two reservations. Out of the two start times (remote controller: time t1, mobile terminal: time t2), the controller 33*a* preferentially selects the earlier start time (t1) and performs the operation start at the selected start time (t1). Consequently, in the case of the example shown in FIG. 17, the operation is started in the reserved operation mode, at the earlier time t1.

Further, when there are overlapped operation times, the controller 33*a* preferentially selects the earlier stop time out of the two stop times and performs the operation stop at that stop time (step S15). This is based on the view that when there is the overlapping of the operation time zones of the air-conditioner, the earlier stop time best reflects the user's intention, with respect to the operation stop.

For example, it can be assumed that the later stop time is set extremely later than the earlier stop time. In such a case, it is often apparent that this later stop time has been set due to the user's error. Then, if a priority is given to the later stop time, the operation will be continued up to the later stop time, resulting in an unnecessary waste of electricity by a useless operation. Therefore, from a standpoint of suppressing the wasteful operation due to the user's erroneous setting as much as possible, giving a priority to the earlier stop time as described above puts greater emphasis on the user's viewpoint.

As shown in FIG. 17, when the operation times of the two reservations partially overlap and there are two reserved times of the operation stop (mobile terminal: time t3, remote controller: time t4), the controller 33*a* preferentially selects the earlier stop time (t3) out of the two stop times. The controller 33*a* performs the operation stop at the selected stop time (t3) (step S15). Therefore, in the air-conditioner shown in FIG. 17, the reserved operation mode stops at the earlier time t3.

Thus, according to the configuration and the action described above, when the operation reservation is set from both of the mobile terminal 16 and the attached remote controller and when the operation times partially overlap, a priority is given to the operation start time and the operation stop time that can be deemed to be effective from the user's viewpoint. This makes it possible to further enhance the convenience of the household electric appliance. In light of greater emphasis on the user's viewpoint, customer satisfaction can be further enhanced.

Second Embodiment

The conventional (e.g., described in Patent Document 1) remote control system transmits an operation start signal or an operation stop signal to a device whose designation code, etc., are input in a menu screen beforehand, when the time input in the menu screen beforehand comes. In the case of the conventional remote control system, however, when the server apparatus is busy at the operation start time or the operation stop time at which the signal is to be transmitted, it is possible that the operation signal or the stop signal cannot be transmitted at the reserved time. Then, there is a risk of the device not operating or stopping normally at the reserved time.

In light of the above problem, a second embodiment according to the present invention provides the household electric appliance, the household electric system, and the server apparatus capable of accurately performing the operation start or the operation stop on time at a set time reserved by the user.

The household electric appliance, the household electric system, and the server apparatus according to the second embodiment will now be described with reference to FIGS. 18 to 20. In the following, description will be made citing the example of the household electric system having at least the air-conditioner as the household electric appliance. The household electric system according to the second embodiment is not limited to the one having the air-conditioner but may be the one having other household electric appliance of the refrigerator, the rice cooker, the washing machine, etc.

<2-1 Configuration>

2-1-1 Overall Configuration of Household Electric System

The configuration of the household electric system according to the second embodiment is substantially the same as that of the household electric system according to the first embodiment shown in FIG. 1. Namely, as shown in FIG. 1, the household electric system 10 according to the second embodiment as well is a system that controls a plurality of household electric appliances by the mobile terminal 16, etc. With respect to the second embodiment as well, description will be made citing three air-conditioners 12-1 to 12-3 and the rice cooker 13 as examples of the plurality of household electric appliances.

The household electric system 10 according to the second embodiment has, in the same manner as in the first embodiment, the air-conditioners 12-1 to 12-3, the rice cooker 13, the radio adaptor (communication device) 14, the mobile terminal 16, the gateway device (relay device) 18, the router device 26, the Internet 20, and the server apparatus 22.

2-1-2 Configuration of Air-Conditioner

The configuration of the air-conditioner according to the second embodiment is substantially the same as that of the air-conditioner according to the first embodiment shown in FIG. 2.

The air-conditioner 12-1 according to the second embodiment, like the air-conditioner according to the first embodiment, is composed of the indoor machine 30 and the outdoor machine 40. As shown in FIG. 2, the indoor machine 30 has the interface 32, the controller 33*a*, the remote controller receiving unit 34, the storage unit 35, and the timer 36. The indoor machine 30 is supplied with power from, for example, the AC source 31 as the commercial power source inside the house 24. The outdoor machine 40 has the controller 33*b*, the fan drive circuit 41, the compressor drive circuit 42, the fan 43, and the compressor 44. The outdoor machine 40 is supplied with power from the indoor machine 30.

2-1-3 Configuration of Server Apparatus

Figure 18:
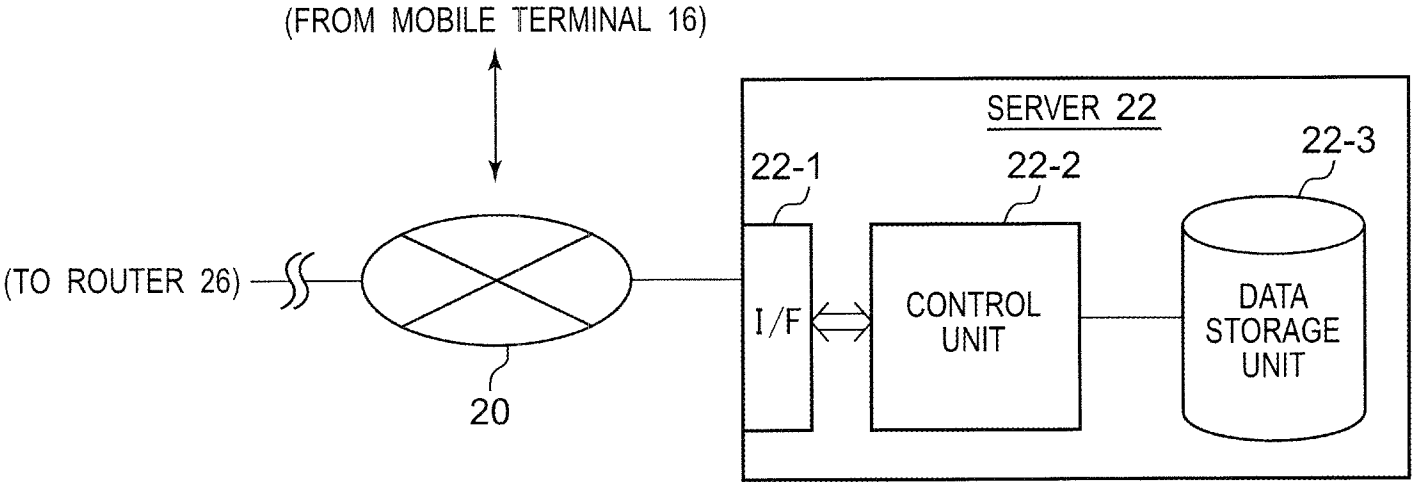
FIG. 18 is a diagram of a configuration of a server apparatus according to a second embodiment.

The configuration will then be described of the server apparatus 22 according to the second embodiment with reference to FIG. 18. As shown in FIG. 18, the server apparatus 22 according to the second embodiment has an interface 22-1, a control unit 22-2, and a data storage unit 22-3.

The interface (I/F) 22-1 is a communicating unit that, under control of the control unit 22-2, performs an exchange of data between the mobile terminal 16 and the router device 26 and the server apparatus 22 by way of the Internet 20.

The control unit 22-2 controls the overall operation of the server apparatus 22. The control unit 22-2 controls the household electric system including the household electric appliances such as the air-conditioner 12-1 to perform the action after the calendar reservation (to be described later). Specifically, the control unit 22-2 receives information indicative of the operation start time or the operation stop time in the reserved operation of the air-conditioner 12-1 from the mobile terminal 16 and transmits a setting signal indicative of the operation start time or the operation stop time to the air-conditioner 12-1. Further, after a first transmission of the setting signal, a predetermined time before the operation start time or the operation stop time indicated by the setting signal, the control unit 22-2 transmits a signal (reservation signal) to instruct the operation starting or stopping the predetermined time later to the air-conditioner 12-1.

The data storage unit 22-3, under control of the control unit 22-2, stores control programs, application programs, and necessary data for execution of the household electric system. The data storage unit 22-3 stores, for example, the information indicative of the operation start time or the operation stop time in the operation reservation, to be transmitted from the mobile terminal 16. The data storage unit 22-3 is composed of, for example, an HDD (Hard Disc Drive) or an SSD (Solid State Drive).

<2-2 Calendar Reservation Action>

2-2-1 Setting of Calendar Reservation Action

The air-conditioners 12-1 to 12-3 according to the second embodiment, in the same manner as in the air-conditioners according to the first embodiment, perform the setting of the calendar reservation action shown in FIGS. 11 to 15.

2-2-2 Action Flow after Calendar Reservation

Figure 19:
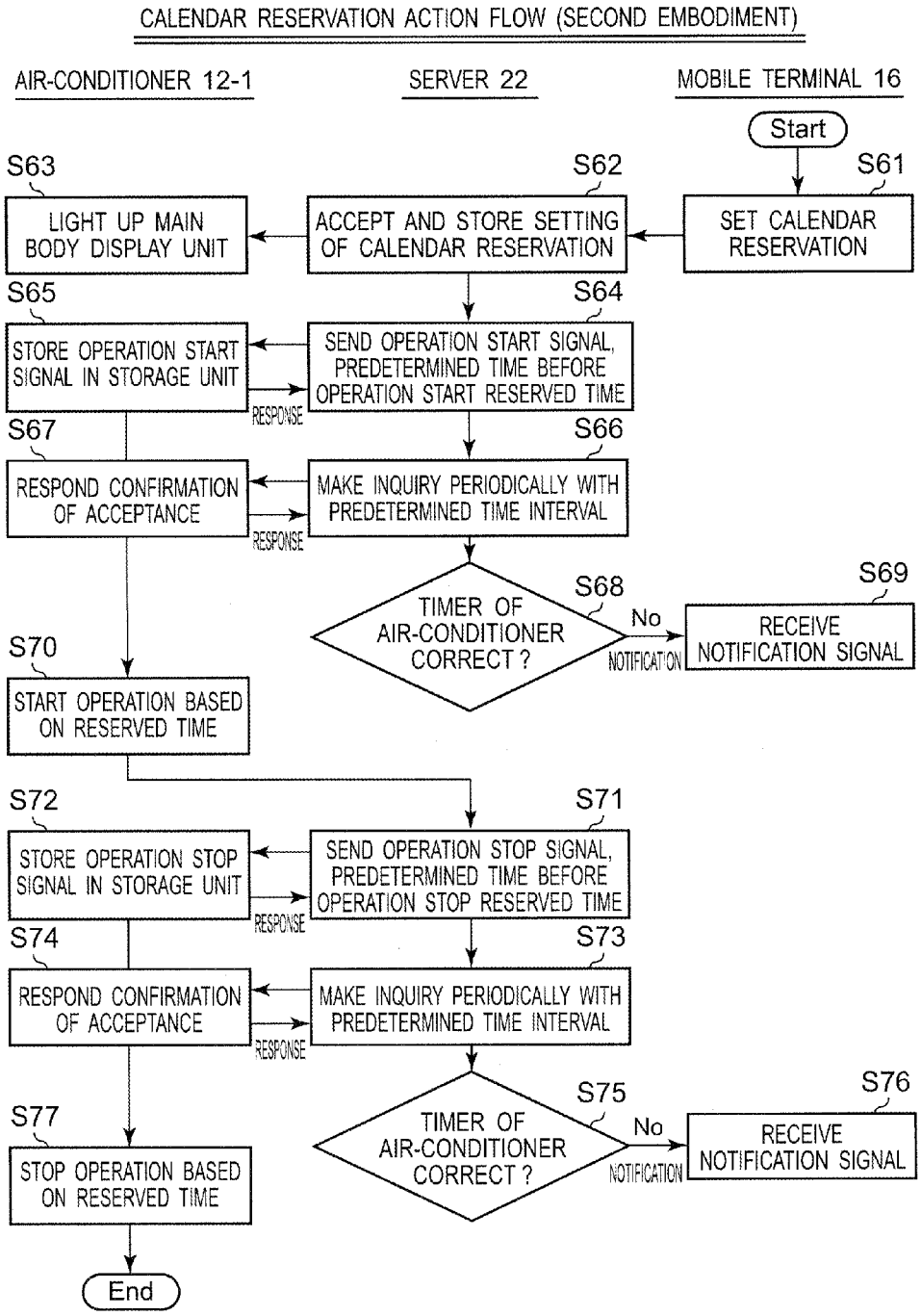
FIG. 19 is a diagram of an operation flow after a calendar reservation in the household electric system according to the second embodiment.

An action flow after the calendar reservation will then be described in the household electric system according to the second embodiment with reference to FIG. 19. The operation reservation will be described that is remotely performed to the air-conditioner 12-1 from the mobile terminal 16. In the following, an example is cited in which the operation start time and the operation stop time of the air-conditioner 12-1 were reserved at "8:00" and "10:00", respectively, from the mobile terminal 16 at 0:00 am.

As described in "1-3-1 Setting of Calendar Reservation Action", the setting is performed, from the mobile terminal 16, of the calendar reservation action to specify the operation action start time and the operation action stop time of the air-conditioner 12-1 (step S61).

Then, the setting contents of the calendar reservation action are accepted by the server apparatus 22 from the mobile terminal 16 by way of the communication channel. The accepted setting contents of the calendar reservation action are stored by the control unit 22-2 of the server apparatus 22 in the data storage unit 22-3 (step S62).

Then, the server apparatus 22 notifies the setting contents of the calendar reservation action to the air-conditioner 12-1 by way of the Internet 20. The controller 33*a* of the notified air-conditioner 12-1 lights up a main body display unit of the indoor machine 30 (step S63). This makes it possible to inform a person inside the house 24 in which the air-conditioner 12-1 is installed that, for example, the calendar reservation was set from outside the house 24 by the mobile terminal 16. In the case of this example, a timer lamp, etc., of the main body display unit start to light from 0:00 am at which the reservation was set.

Then, the server apparatus 22 notifies an operation start reservation signal to the air-conditioner 12-1 by way of the Internet 20, the predetermined time before an operation start reserved time (step S64). In this example, the server apparatus 22 notifies the operation start reservation signal to the air-conditioner 12-1 by way of the interface 32 at time "7:30", the predetermined time "30 minutes" before the operation start reserved time "8:00".

The notified controller 33*a* stores the received operation start reservation signal in the storage unit 35. Upon completion of the storage thereof in the storage unit 35, the controller 33*a* sends back a response signal to the server apparatus 22 (step S65).

Then, the server apparatus 22 makes an inquiry to the air-conditioner 12-1 periodically with a predetermined time interval until the response signal from the air-conditioner 12-1 is sent back to confirm the acceptance. The inquiry made by the server apparatus 22 is of the same contents as those notified at step S64 and this inquiry is made repeatedly (step S66). In this example, the server apparatus 22 makes the inquiry to the air-conditioner 12-1 periodically with the predetermined time "10 minute" interval by repeatedly transmitting the same reservation signal as at step S64.

The controller 33*a* in reception of the inquiry sends back a response signal of the timer 36 to the server apparatus 22. Further, the controller 33*a* updates the time up to the operation start stored in the storage unit 35 so that it can start the operation of the air-conditioner at the time after an elapse of the predetermined time from the time at which the inquiry is received. Namely, the controller 33*a* updates the time up to the operation start stored in the storage unit 35 to such as 30 minutes later, 29 minutes later, . . . 15 minutes later (step S67). For example, when "10 minutes" have passed from the time at which the reservation signal of 30 minutes before the operation start time was received from the server apparatus 22, the controller 33*a* updates the time up to the operation start stored in the storage unit 35 so that the operation will be started 20 minutes later.

The server apparatus 22 determines whether the reservation is correctly set, based on the time of the timer 36 of the air-conditioner 12-1 (step S68). For example, the server apparatus 22 confirms whether the time of the timer 36 of the air-conditioner 12-1 matches the value to be set after an elapse of "10 minutes" from the time set at the time of the transmission of the operation start reservation signal of step S64.

If the timer 36 of the air-conditioner 12-1 is not normal, namely, the reservation action is not set correctly (No at step S68), then the server apparatus 22 transmits a notification signal to the mobile terminal 16 from which the reservation is set. From the server apparatus 22 the mobile terminal 16 receives the notification signal to the effect that the reserved time of the operation start of the air-conditioner 12-1 is abnormal (step S69). This makes it possible for the user to know that the reserved time of the operation start of the air-conditioner 12-1 is abnormal.

The controllers 33*a* and 33*b* of the air-conditioner 12-1, when judging, based on the time of the timer 36, that the reserved time of the operation start has come, perform the operation start (step S70). In this example, when judging based on the time notified by the timer 36 that the reserved time of the operation start "8:00" has come, the controllers 33*a* and 33*b* perform the operation start in the operation mode set previously, for example, in the "cooling" mode.

Further, the following action flow of the operation stop is executed in the same manner as the foregoing action flow of the operation start. Namely, the server apparatus 22 notifies an operation stop reservation signal to the air-conditioner 12-1 by way of the Internet 20, the predetermined time before an operation stop reserved time (step S71). In this example, the server apparatus 22 notifies the operation stop reservation signal to the air-conditioner 12-1 by way of the interface 32 at time "9:30", the predetermined time "30 minutes" before the operation stop reserved time "10:00".

The notified controller 33*a* stores the received operation stop reservation signal in the storage unit 35. Upon completion of the storage thereof in the storage unit 35, the controller 33*a* sends back a response signal to the server apparatus 22 (step S72).

Then, the server apparatus 22 makes an inquiry to the air-conditioner 12-1 periodically with a predetermined time interval until the response signal from the air-conditioner 12-1 is sent back to confirm the acceptance. The inquiry made by the server apparatus 22 is of the same contents as those notified at step S71 and this inquiry is made repeatedly (step S73). In this example, the server apparatus 22 makes the inquiry to the air-conditioner 12-1 periodically with the predetermined time "10 minute" interval by repeatedly transmitting the same reservation signal as at step S71.

The controller 33*a* in reception of the inquiry sends back a response signal of the timer 36 to the server apparatus 22. Further, the controller 33*a* updates the time up to the operation stop stored in the storage unit 35 so that it can stop the operation of the air-conditioner at the time after an elapse of the predetermined time from the time at which the inquiry is received (step S74). For example, when "10 minutes" have passed from the time at which the reservation signal of 30 minutes before the operation stop time was received from the server apparatus 22, the controller 33*a* updates the time up to the operation stop stored in the storage unit 35 so that the operation will be stopped 20 minutes later.

The server apparatus 22 determines whether the reservation is correctly set, based on the time of the timer 36 of the air-conditioner 12-1 (step S75). For example, the server apparatus 22 confirms whether the time of the timer 36 of the air-conditioner 12-1 matches the value to be set after an elapse of "10 minutes" from the time set at the time of the transmission of the operation stop reservation signal of step S71.

If the timer 36 of the air-conditioner 12-1 is not normal, namely, the reservation action is not set correctly (No at step S75), then the server apparatus 22 transmits a notification signal to the mobile terminal 16 from which the reservation is set. From the server apparatus 22 the mobile terminal 16 receives the notification signal to the effect that the reserved time of the operation stop of the air-conditioner 12-1 is abnormal (step S76). This makes it possible for the user to know that the reserved time of the operation stop of the air-conditioner 12-1 is abnormal.

The controllers 33*a* and 33*b* of the air-conditioner 12-1, when judging, based on the time of the timer 36, that the reserved time of the operation stop has come, perform the operation stop in the operation mode set previously, for example, in the "cooling" mode (step S77). In this example, when the reserved time of the operation stop "10:00" has come based on the time notified by the timer 36, the controllers 33*a* and 33*b* perform the operation stop.

The example of the action flow shown in FIG. 19 will be described time-serially with reference to FIG. 20. In the same manner as described above, the case is cited in which the operation start time and the operation stop time of the air-conditioner 12-1 are reserved at "8:00" and "10:00", respectively, by the mobile terminal 16 at 0:00 am.

Figure 20:
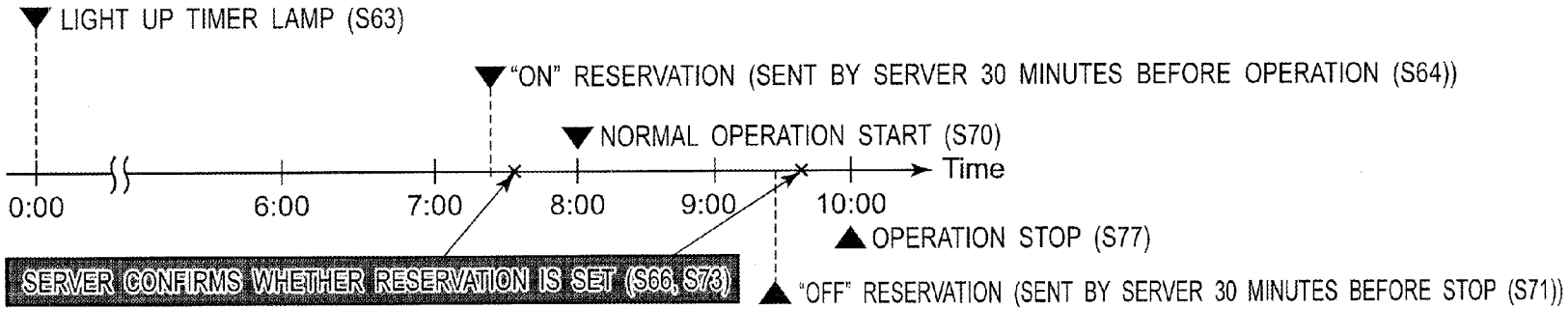
FIG. 20 is a timing chart after the calendar reservation in the household electric system according to the second embodiment.

As shown in FIG. 20, when the calendar reservation is set by the mobile terminal 16 at 0:00 am, the air-conditioner 12-1 lights up the timer lamp of the main body display unit of the indoor machine 30 at time "0:00" (step S63).

Then, the air-conditioner 12-1, notified of the operation start reservation signal at time "7:30", the predetermined time "30 minutes" before the operation start reserved time "8:00", from the server apparatus 22 (step S64), has the operation start reservation set.

Then, the air-conditioner 12-1, by receiving the inquiry from the server apparatus 22 periodically with the predetermined time "10 minute" interval, is asked to confirm whether the operation start reservation is set (step S66).

Then, when the operation start reserved time "8:00" has come, based on the time notified from the timer 36, the air-conditioner 12-1 performs the operation start in the operation mode previously set, for example, the "cooling" mode (step S70).

Then, the air-conditioner 12-1, notified of the operation stop reservation signal at time "9:30", the predetermined time "30 minutes" before the operation stop reserved time "10:00", from the server apparatus 22 (step S71), has the operation stop reservation set.

Then, the air-conditioner 12-1, by receiving the inquiry from the server apparatus 22 periodically with the predetermined time "10 minute" interval, is asked to confirm whether the operation stop reservation is set (step S73).

Then, when the operation stop reserved time "10:00" has come, based on the time notified from the timer 36, the air-conditioner 12-1 performs the operation stop.

In this example, as described above, description has been made citing as an example the case in which the reservation signal of the operation start and the operation stop is notified to the air-conditioner 12-1, with the predetermined time before the reserved time of the operation start and the operation stop set at 30 minutes. The predetermined times before the reserved time, however, are not limited to 30 minutes but may be made changeable independently of each other, as required.

<2-3 Effect>

The household electric appliance, the household electric system, and the server apparatus according to the second embodiment can have the following effect (1).

(1) The operation start and the operation stop can be performed accurately on time at the reserved set time.

As described above, the air-conditioner (household electric appliance) 12-1 is a household electric appliance capable of the reserved operation of performing the start and the stop of the operation at the set time. The air-conditioner has the interface 32, the controllers (control unit) 33*a* and 33*b*, and the storage unit 35. The interface 32 receives the setting signal indicative of the operation start time or the operation stop time in the reserved operation of the air-conditioner 12-1 from the predetermined server apparatus 22 connected by way of the Internet 20. The controllers (control unit) 33*a* and 33*b* control the overall operation of the air-conditioner 12-1. The storage unit 35 stores predetermined data.

Further, the controllers 33*a* and 33*b*, after the first reception of the setting signal (step S63), the predetermined time before the time of the operation start or the operation stop indicated by the setting signal, receive the setting signal to instruct the operation starting or stopping the predetermined time later. The controllers 33*a* and 33*b* then store contents of the setting signal in the memory unit 35 (step S65, step S72) and execute the reserved operation in accordance with the contents of the setting signal stored in the storage unit 35.

According to the configuration and the operation described above, even if, for example, the server apparatus 22 is busy or congested, the server apparatus 22 transmits, the predetermined time earlier, the reservation signal to start or stop the operation the predetermined time later to the air-conditioner 12-1 (step S64, step S71). Consequently, the air-conditioner 12-1 that receives the reservation signal the predetermined time earlier can perform the operation start or the operation stop accurately on time at the reserved setting time even if the server apparatus 22 is busy. The configuration and the operation described above, which can avoid the communication at the busy time of the server apparatus 22, are effective in reducing the load of the server apparatus 22.

Further, when the household electric appliance is the air-conditioner as in this example, a plurality of air-conditioners connected to the server apparatus 22 often have the operation start times and the operation stop times close to one another, because of the characteristics of the household electric appliance. The household electric system according to the second embodiment can avoid the congested communication due to such closeness, resulting in a great advantage of reduced load of the server apparatus 22.

Third Embodiment an example of same action as that of remote controller attached to main body)]

Figure 21:
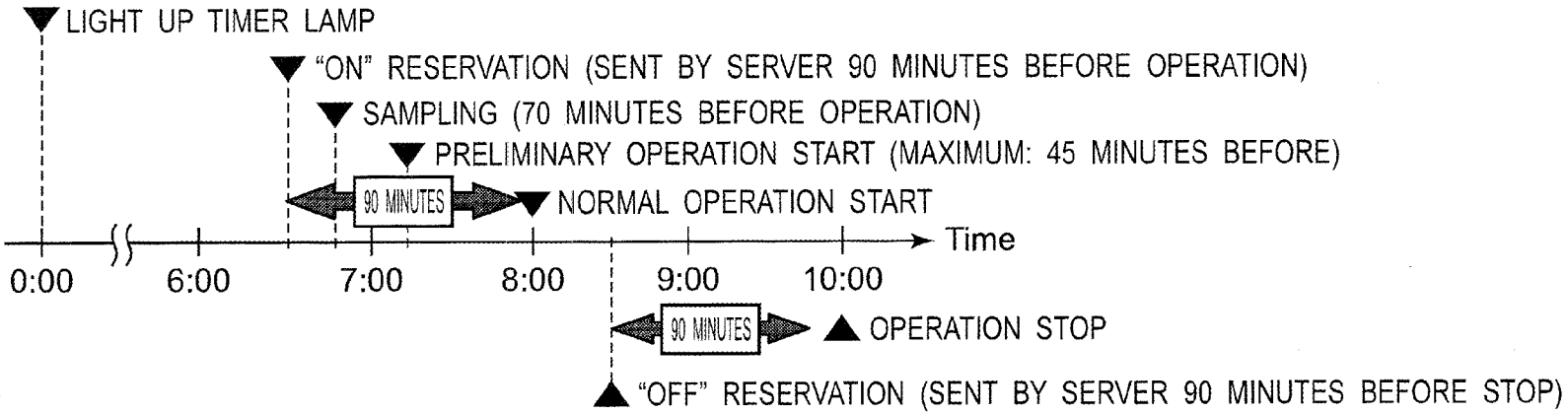
FIG. 21 is a timing chart after the calendar reservation in the household electric system according to a third embodiment.

The household electric appliance, the household electric system, and the server apparatus according to a third embodiment will be described with reference to FIG. 21. In this embodiment, description is omitted of portions overlapping those of the second embodiment.

In the third embodiment, the calendar reservation set by the mobile terminal 16 is the same as the calendar reservation set by the remote controller attached to the main body of the air-conditioners 12-1 to 12-3.

The third embodiment, however, is so configured that, in the case of the calendar reservation by the remote controller, a plurality of reservations cannot be set within a predetermined time (e.g., 90 minutes). Namely, the third embodiment is so configured that a space of a predetermined time (e.g., 90 minutes) or longer must be placed between two reservations.

It may be so arranged that, in the case of the reservation setting by the mobile terminal as well, a space of a predetermined time (e.g., 90 minutes) or longer must be placed between two reservations, in the same manner as in the case of the reservation setting by the remote controller.

The household electric appliance, the household electric system, and the server apparatus according to the third embodiment can have the same effect as that of (1) above. Further, the household electric appliance, the household electric system, and the server apparatus according to the third embodiment make it possible for the remote controller attached to the main body to perform the calendar reservation by the mobile terminal 16.

INDUSTRIAL APPLICABILITY

The present disclosure is applicable to the household electric appliance such as the air-conditioner and the household electric system controlling the household electric appliance.

DESCRIPTION OF THE REFERENCE NUMERALS

10 . . . household electric system, 12-1 to 12-3 . . . air-conditioner (household electric appliance), 13 . . . rice cooker (household electric appliance), 14 . . . radio adaptor (communication device), 16 . . . mobile terminal, 18 . . . gateway device (relay device), 20 . . . Internet, 22 . . . server apparatus, 26 . . . router device, 30 . . . indoor machine, 33*a*, 33*b* . . . controller (control unit), 32 . . . interface (receiving unit), 34 . . . remote controller receiving unit (receiving unit), 35 . . . storage unit, 36 . . . timer, 40 . . . outdoor machine

The invention claimed is:

1. A household electric appliance capable of a reserved operation of performing an operation start or stop at a set time, the appliance comprising:

a receiving unit that receives a setting signal indicative of an operation start time in the reserved operation of the household electric appliance from each of a remote controller and a mobile terminal;

a storage unit that stores contents of the setting signal; and a control unit that controls the operation of the household electric appliance, wherein the control unit, in the case of at least partially overlapping of an operation time zone defined by the setting signal from the remote controller and an operation time zone defined by the setting signal from the mobile terminal, selects the earlier time out of the two operation start times set by the remote controller and the mobile terminal and performs the operation start at the selected time.

2. The household electric appliance of claim 1, wherein the receiving unit further receives the setting signals indicative of an operation stop time of the household electric appliance from the remote controller and the mobile terminal, and wherein the control unit, in the case of at least partially overlapping of an operation time zone defined by the setting signal from the remote controller and an operation time zone defined by the setting signal from the mobile terminal, selects the earlier time out of the two operation stop times set by the remote controller and the mobile terminal and performs the operation stop at the selected time.

3. A mobile terminal that sets a reserved operation to the household electric appliance described in claim 1, the mobile terminal comprising:

a display unit that displays information indicating that the reserved operation is already set and/or information indicating that the reserved operation is not set normally, in the household electric appliance.

4. A household electric system comprising:

the household electric appliance described in claim 1;

the mobile terminal described in claim 3 that inputs setting information to set an operation start time and/or an operation stop time for the reserved operation; and a server apparatus that receives the setting information from the mobile terminal and transmits the setting signal to the household electric appliance.

5. A server apparatus that enables a reserved operation of a household electric appliance from a mobile terminal by way of a network, the server apparatus comprising:

a communicating unit that performs a communication with the mobile terminal and the household electric appliance by way of the network; and a control unit that receives information indicative of an operation start time or an operation stop time in the reserved operation of the household electric appliance from the mobile terminal by way of the communicating unit and transmits a setting signal indicative of the operation start time or the operation stop time to the household electric appliance, wherein the control unit, after a first transmission of the setting signal, a predetermined time before the operation start time or the operation stop time indicated by the setting signal, transmits a signal to instruct starting or stopping of the operation the predetermined time later to the household electric appliance.

6. The server apparatus of claim 5, wherein the communicating unit, after the first transmission of the setting signal to the household electric appliance, repeatedly transmits the setting signal to the household electric appliance until the setting signal is correctly accepted by the household electric appliance.

7. The server apparatus of claim 6, wherein the communicating unit, after the first transmission of the setting signal to the household electric appliance, makes an inquiry to the household electric appliance as to whether the reserved operation is correctly set based on the setting signal and if the reserved operation is not correctly set, then the communicating unit notifies the mobile terminal accordingly.

8. A household electric appliance capable of a reserved operation of performing an operation start or stop at a set time, the appliance comprising:

a receiving unit that receives a first setting signal indicative of an operation start time or an operation stop time in the reserved operation of the household electric appliance from a predetermined server apparatus connected by way of a network;

a control unit that controls the operation of the household electric appliance; and a storage unit that stores data, wherein the control unit, after a first reception of the first setting signal, a predetermined time before the operation start time or the operation stop time indicated by the first setting signal, receives a second setting signal instructing starting or stopping of the operation the predetermined time later, stores contents of the second setting signal in the storage unit, and executes the reserved operation in accordance with the contents of the second setting signal stored in the storage unit, wherein the control unit, after the first reception of the first setting signal from the server apparatus, repeatedly receives the second setting signal to be transmitted with a predetermined time interval therefrom until the second setting signal is correctly accepted, and wherein the control unit, at the time of the correct acceptance of the second setting signal, updates the contents stored in the storage unit based on the correctly accepted second setting signal.

9. The household electric appliance of claim 8, wherein the control unit lights up a display unit at the time of the reception of the first setting signal from the server apparatus.

10. A household electric system comprising:

the server apparatus described in claim 5; and the household electric appliance described in claim 8.

* * * * *